US006837841B2

(12) United States Patent
Trovinger

(10) Patent No.: US 6,837,841 B2
(45) Date of Patent: Jan. 4, 2005

(54) METHOD AND APPARATUS FOR SHEET FOLDING

(75) Inventor: Steven W. Trovinger, Los Altos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/259,458

(22) Filed: Sep. 30, 2002

(65) Prior Publication Data

US 2004/0063560 A1 Apr. 1, 2004

(51) Int. Cl.[7] ..... B31F 1/10

(52) U.S. Cl. ..... 493/444; 493/406; 493/442; 493/447; 493/449; 493/457

(58) Field of Search ..... 493/405, 406, 493/442, 444, 446, 447, 449, 455, 457

(56) References Cited

U.S. PATENT DOCUMENTS

| | | | |
|---|---|---|---|
| 3,202,066 A | 8/1965 | Palmer | |
| 3,398,661 A | 8/1968 | Mathes et al. | |
| 3,434,399 A | 3/1969 | Palmer | |
| 3,916,749 A | 11/1975 | Armelin | |
| 3,978,773 A | 9/1976 | Pinto | |
| 3,995,849 A | 12/1976 | Kistner | |
| 4,015,838 A | 4/1977 | Thurmann | |
| 4,041,849 A | 8/1977 | Tsukasaki | |
| 4,053,150 A | 10/1977 | Lane | |
| 4,101,121 A | 7/1978 | Rastorguyeff | |
| 4,221,373 A | 9/1980 | Muller-Hans | |
| 4,226,410 A | 10/1980 | McIntosh, Sr. et al. | |
| 4,265,437 A | 5/1981 | Reist et al. | |
| 4,496,339 A | 1/1985 | Moll | |
| 4,557,714 A | 12/1985 | Sabelstrom et al. | |
| 4,595,187 A | 6/1986 | Bober | |
| 4,614,512 A | 9/1986 | Capdeboscq | |
| 4,643,705 A | 2/1987 | Bober | |
| 4,834,696 A | 5/1989 | Marschke | |
| 4,891,681 A | 1/1990 | Fiske et al. | |
| 4,893,803 A | 1/1990 | Petersen | |
| 5,028,193 A | 7/1991 | Misicka | |
| 5,080,339 A | 1/1992 | Hirahara | |
| 5,087,163 A | 2/1992 | Erdbories et al. | |
| 5,092,827 A | 3/1992 | McAdam, III et al. | |
| 5,112,291 A | * 5/1992 | VerMehren | 493/409 |
| 5,114,392 A | 5/1992 | McAdam, III et al. | |
| 5,147,276 A | 9/1992 | Stab | |
| 5,169,376 A | 12/1992 | Ries et al. | |
| 5,190,514 A | 3/1993 | Galvanauskas | |
| 5,230,686 A | 7/1993 | McAdam, III et al. | |
| 5,242,364 A | 9/1993 | Lehmann | |
| 5,346,350 A | 9/1994 | Luhman et al. | |
| 5,377,965 A | 1/1995 | Mandel et al. | |
| 5,452,920 A | 9/1995 | Parker | |
| 5,465,213 A | 11/1995 | Ross | |

(List continued on next page.)

FOREIGN PATENT DOCUMENTS

| | | |
|---|---|---|
| DE | 128017 | 3/1901 |
| FR | 2326113 | 4/1977 |
| WO | WO00/18583 | 4/2000 |

*Primary Examiner*—Eugene Kim
*Assistant Examiner*—Christopher Harmon

(57) ABSTRACT

A sheet folding apparatus is described including a fold blade, a clamp movable to engage the fold blade, and a fold blade receptacle having two flexible spring members. The flexible spring members are biased toward one another by preloading material of the spring members. The fold blade and fold blade receptacle are movable toward one another to fold a sheet of material.

27 Claims, 12 Drawing Sheets

U.S. PATENT DOCUMENTS

| | | | |
|---|---|---|---|
| 5,738,620 | A | 4/1998 | Ebner et al. |
| 5,803,891 | A | 9/1998 | Haan et al. |
| 5,937,757 | A | 8/1999 | Jackson et al. |
| 5,979,348 | A | 11/1999 | Yaguchi |
| 5,997,459 | A | 12/1999 | Kruger et al. |
| 6,090,032 | A | 7/2000 | Bellanca |
| 6,094,225 | A | 7/2000 | Han |
| 6,120,427 | A | 9/2000 | Haan et al. |
| 6,193,458 | B1 | 2/2001 | Marsh |
| 6,363,851 | B1 | 4/2002 | Gerhard et al. |

* cited by examiner

METHOD AND APPARATUS FOR SHEET FOLDING

BACKGROUND OF THE INVENTION

1. Field of the Invention

The present invention generally relates to folding sheet material and, more particularly, to a sheet folding apparatus using flexible spring members which are arranged to move with respect to a fold blade to fold a sheet of material.

2. Background Information

A system for finishing printed sheets into booklets is described in PCT Document No. WO 00/18583 (hereafter referred to as "the Trovinger PCT"), hereby incorporated by reference in its entirety. The Trovinger PCT includes an operation where individual booklet sheets are folded using two drive motor assemblies. A first vertical drive motor assembly operates to immobilize a sheet by pressing it against a fold blade with a folder assembly. This first vertical drive motor assembly moves a set of fold rollers into contact with both the sheet and a longitudinal fold blade. The axes of rotation for the fold rollers are perpendicular to the fold blade used to fold each sheet. A second horizontal drive motor then operates to deform the sheet against the fold blade by reciprocating the set of fold rollers, which have been placed into contact with the sheet, back and forth along the fold blade to crease the sheet. The number and spacing of these fold rollers are such that during horizontal movement of the fold rollers, at least one fold roller passes over every point along the portion of a sheet where a fold is to be formed.

The system described in the Trovinger PCT uses two separate motors to establish linear motion of fold rollers in two axes to create a fold. The time to create a fold includes the cumulative time of moving a folder assembly vertically and moving the fold rollers horizontally to crease the sheet.

Another folder apparatus is disclosed in U.S. Pat. No. 4,053,150 (Lane), hereby incorporated by reference in its entirety, which is directed to the prevention of corner dog-earring. The Lane patent includes a blade for forcing once-folded paper (e.g., a folded stack of newsprint) between a pair of rollers, thus creating a quarter-fold in the paper. Air flow jets and plates are used in the Lane patent to prevent bending of the paper edges and corners. However, the Lane patent is designed for folding entire stacks of sheets and generally does not make precise, sharp folds, or ensure proper paper alignment during a fold process.

It would be desirable to reduce the apparatus cost and the time required to form a precise fold in a sheet.

SUMMARY OF THE INVENTION

The present invention is directed to an apparatus that folds sheet material using a fold blade and flexible spring members.

According to an exemplary embodiment of the present invention, a sheet folding apparatus is provided, including a fold blade, a clamp movable to engage the fold blade, and a fold blade receptacle having two flexible spring members biased toward one another by pre-loading material of the spring members, wherein the fold blade and the fold blade receptacle are movable toward one another to fold a sheet of material.

According to a second embodiment of the present invention, an apparatus for folding sheet material is provided, including a fold blade, clamping means for clamping a sheet against the fold blade, folding means for folding the sheet over the fold blade, the folding means including two flexible spring members for receiving the fold blade between the fingers, and drive means for moving at least one of the fold blade and the folding means into a position where the fold blade is between the two flexible spring members and the sheet is folded over the fold blade and between the fingers.

According to a third embodiment of the present invention, a method for folding sheet material, comprises the steps of: feeding a sheet into an area between a fold blade and a fold blade receptacle; clamping the sheet against the fold blade with a clamp; and folding the sheet by moving the fold blade and the fold blade receptacle relative to one another to form a fold in the sheet by a biasing force pre-loaded in a material the fold blade receptacle.

According to a fourth embodiment of the present invention, a sheet folding apparatus comprises a fold blade, a clamp movable to engage the fold blade, a plurality of sequentially activated members movably mounted on each side of the clamp for folding a sheet, and an activation system for advancing the sequentially activated members to fold the sheet, wherein the members farthest from the fold blade are activated first.

BRIEF DESCRIPTION OF THE DRAWINGS

Other objects and advantages of the present invention will become more apparent from the following detailed description of preferred embodiments, when read in conjunction with the accompanying drawings wherein like elements have been represented by like reference numerals and wherein.

DETAILED DESCRIPTION OF THE PREFERRED EMBODIMENTS

Figure 1A:
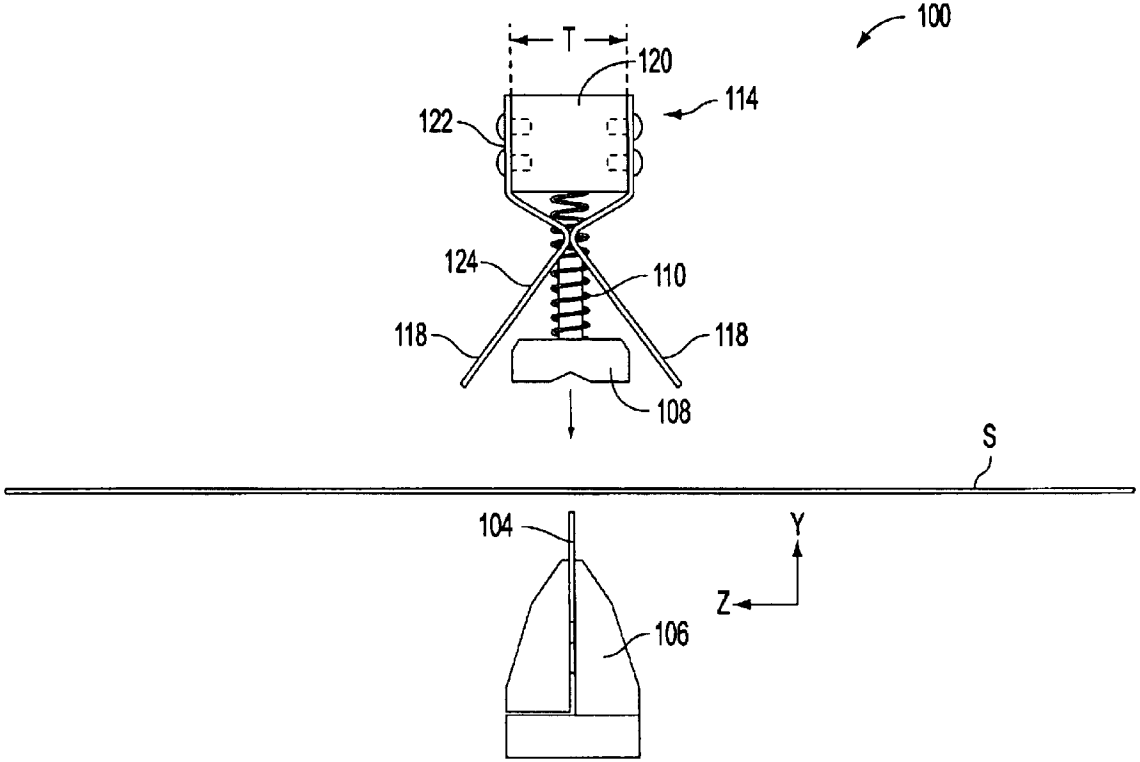
FIG. 1A is a side view of a sheet folding apparatus in accordance with an exemplary embodiment of the present invention prior to the folding of a sheet.
Figure 1B:
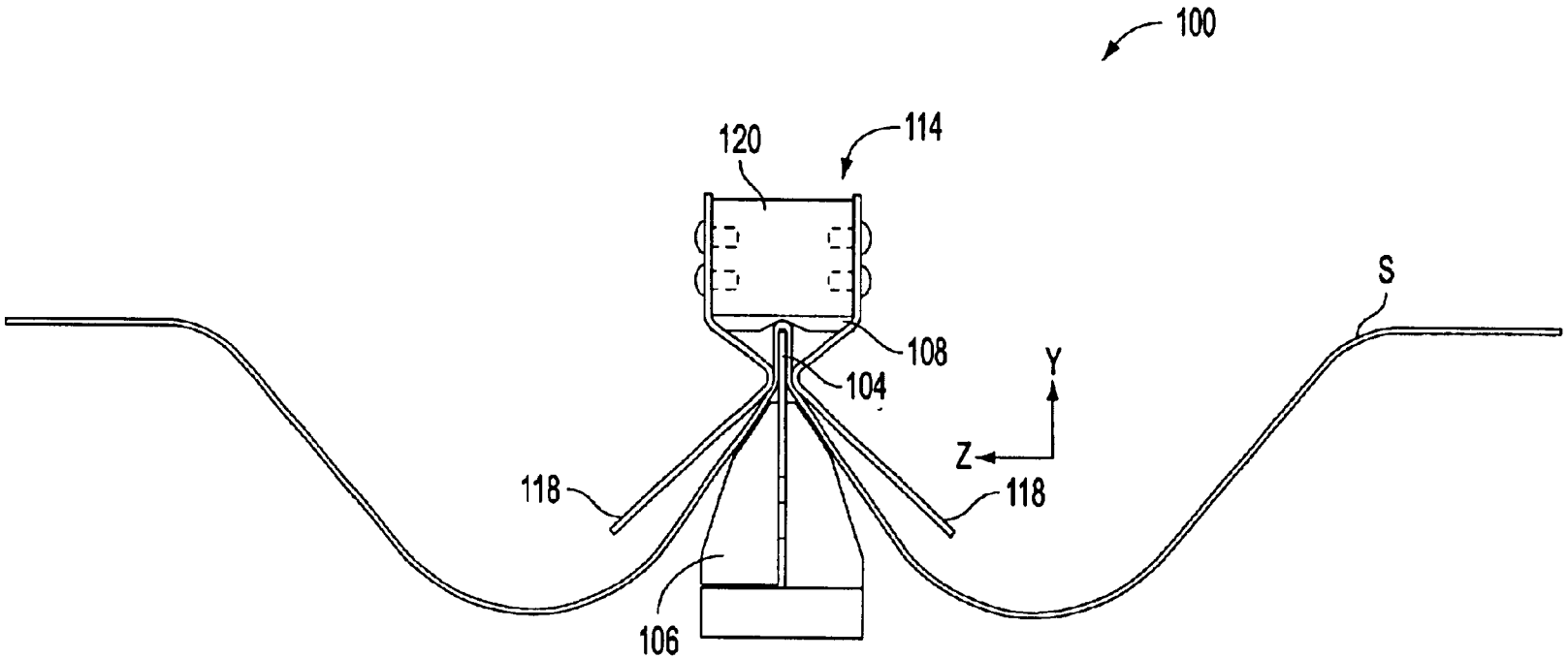
FIG. 1B is a side view of the sheet folding apparatus of FIG. 1A during folding of the sheet.

An exemplary embodiment of an apparatus for folding sheet material represented as apparatus 100 in FIGS. 1A–1C and 2. The exemplary apparatus 100 includes a fold blade, such as fold blade 104 having a longitudinal axis A along the x-axis of FIG. 2. The apparatus 100 also includes a clamping means, such as clamps 108, illustrated in FIGS. 1A–1C and 2. Clamps 108 are biased by springs 110 to located and lock a sheet S in position in contact with blade 104. Clamps 108 are mounted by springs 110 on a folding means, such as fold blade receptacle 114 of FIGS. 1A–1C. As shown in the exemplary embodiment of FIGS. 1A–1C, fold blade receptacle 114 includes two flexible spring members 118 fixed to a support 120. Fold blade receptacle 114 and fold blade 104 are moveable with respect to one another to fold sheet S around the fold blade. As shown in FIG. 1B, as sheet S is folded around fold blade 104, flexible spring members 118 flex outward to receive the sheet and fold blade and the spring bias of flexible spring members 118 achieves a sharp fold with a simple folding apparatus design.

Figure 1C:
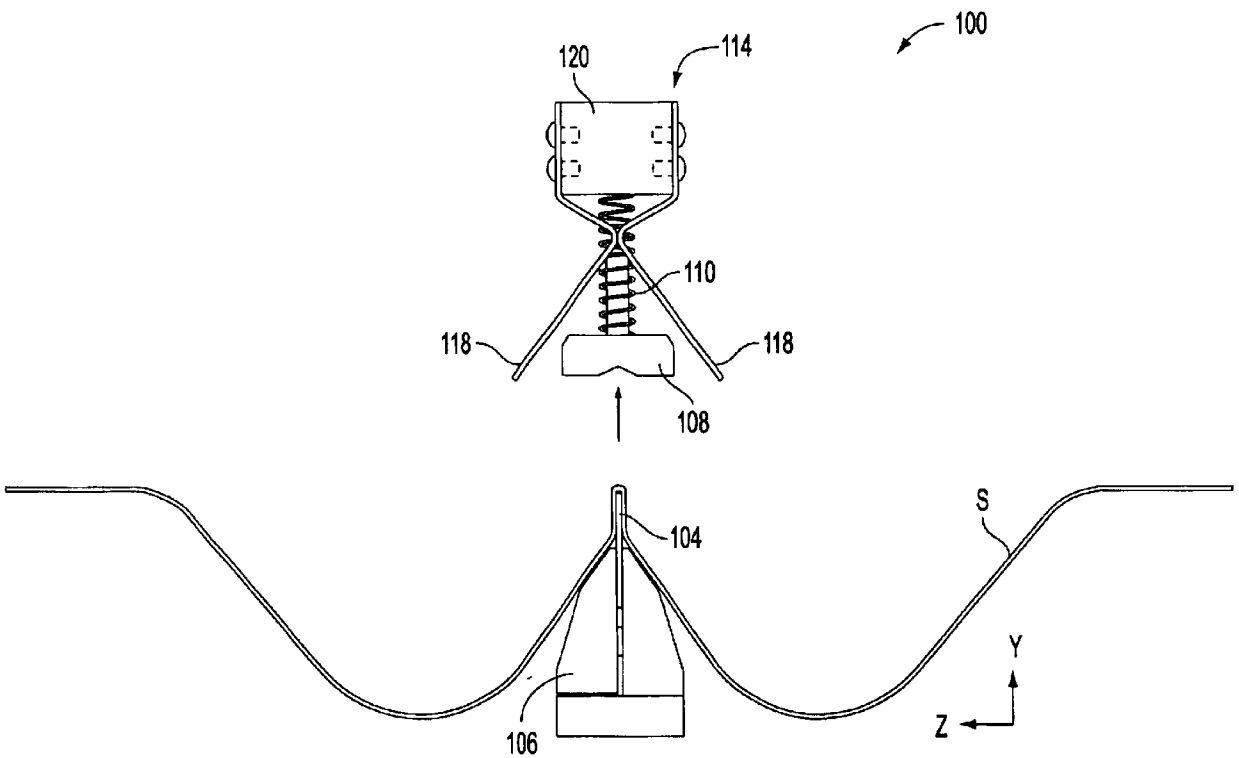
FIG. 1C is a side view of the sheet folding apparatus of FIG. 1A after folding of the sheet.

Fold blade 104 is shown to be held by a blade holder 106, but can alternatively be held by any other stabilizing structure or can be manufactured with blade holder 106 as a unitary component. Fold blade 104 can be fixed or can alternatively be movable (for example, along the y-axis of FIG. 1A, or any desired axis) by using a device such as a blade motor. As shown in FIGS. 1A–1C, fold blade 104 can be positioned in a plane which passes between the two flexible spring members 118.

Fold blade 104 can be made of metal or any other formable material, and can be shaped as a flat strip, as shown, or can include a rounded shape, these examples being non-limiting, of course. For example, the cross-section of fold blade 104 can alternatively be triangular, or the blade faces can be concave or convex, instead of flat as shown.

Flexible spring members 118 as shown in FIGS. 1A–1C and FIG. 2, include six independent spring members mounted on support 120 in three pairs with two clamps 108 positioned between the pairs of flexible spring members to pinch and hold sheet S against fold blade 104 during folding. The flexible spring members each include a first end 122 secured to support 120 and a free end or a cantilevered portion 124. In the exemplary embodiment illustrated in FIGS. 1A–1C, cantilevered portions 124 of flexible spring members 118 are substantially L-shaped and are spring biased into contact with one another prior to folding. The entire flexible spring members 120 are substantially Z- or S-shaped. During folding of sheet S, flexible spring members 118 flex outward with the central portions of the flexible spring members pressing the sheet against the fold blade.

A pre-loaded spring force of the flexible spring members 118 can be selected to achieve an optimal sharp fold with a minimum damage to the sheet material. The pre-loaded force of the flexible spring members 118 may be varied by changing many factors, including material, shape, and thickness of flexible spring members 118 and a thickness T of support 120.

Figure 2:
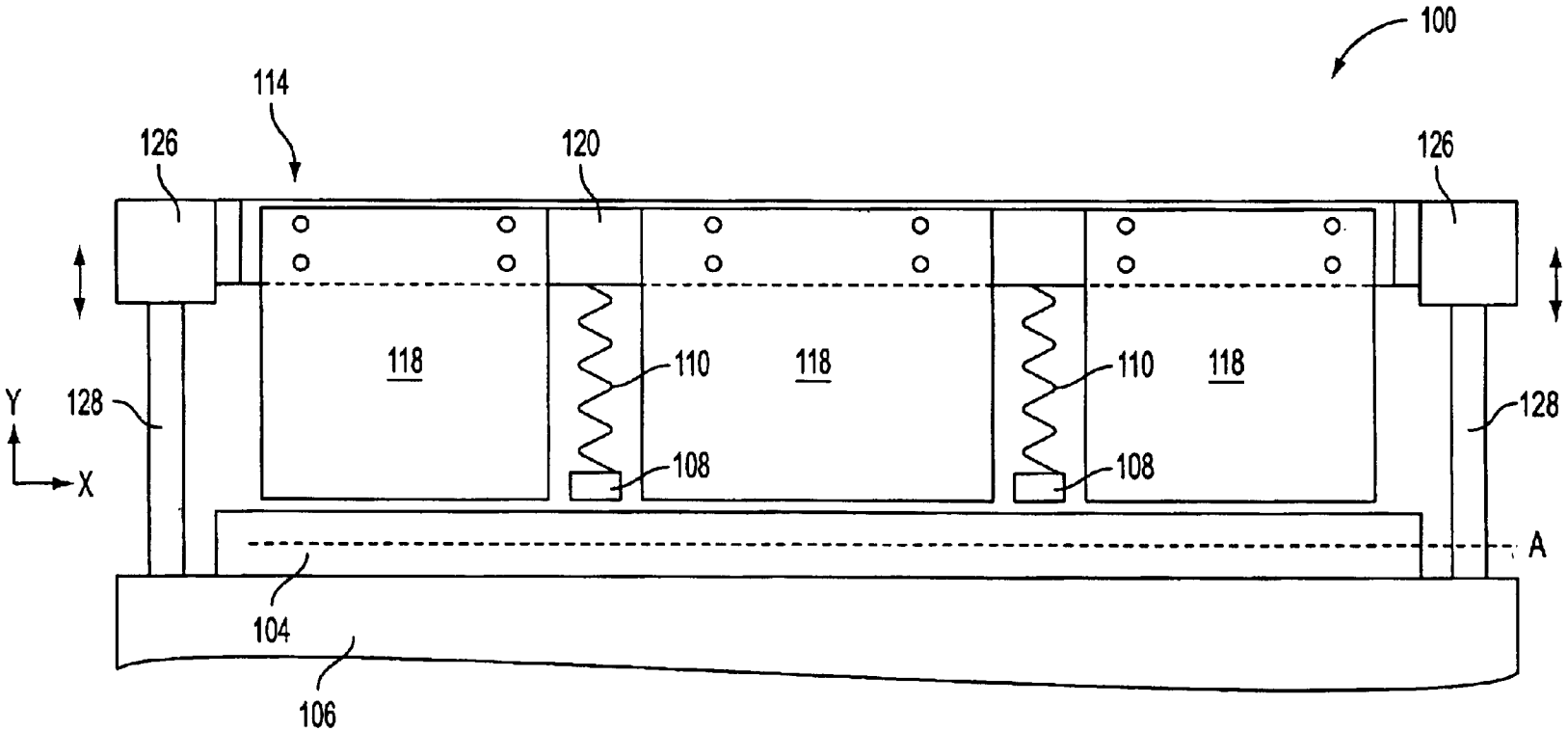
FIG. 2 is a front view of the sheet folding apparatus in accordance with an exemplary embodiment of the present invention.

As illustrated in FIG. 2, flexible spring members 118 are arranged with spaces between adjacent pairs of spring fingers for receiving clamps 108 and springs 110. Clamps 108 and springs 110 can be located at a position at which the booklet will subsequently be stapled. Thus, in a booklet which is made with two staples, a fold blade receptacle 114 having two clamps 108 and three pairs of flexible spring members 118, would be preferred. However, it should be understood that any number of flexible spring members 118 and clamps 108 may be employed. A width of clamps 108 and springs 110 in the X direction in FIG. 2, can be minimized to reduce the area of the sheet where less sharp fold is made.

Although cantilevered ends 124 of flexible spring members 118 illustrated are substantially L-shaped, it should be understood that other shapes may be employed, such as C- or U-shaped spring members.

Fold blade 104 and fold blade receptacle 114 are moved with respect to one another to achieve folding of sheet S. This motion may be provided by moving one or both of fold blade 104 and fold blade receptacle 114. As shown in FIG. 2, they may be movable by providing couplings 126 which are moveable on rails 128 by a drive means which will be discussed in further detail with respect to FIG. 6.

Figure 3:
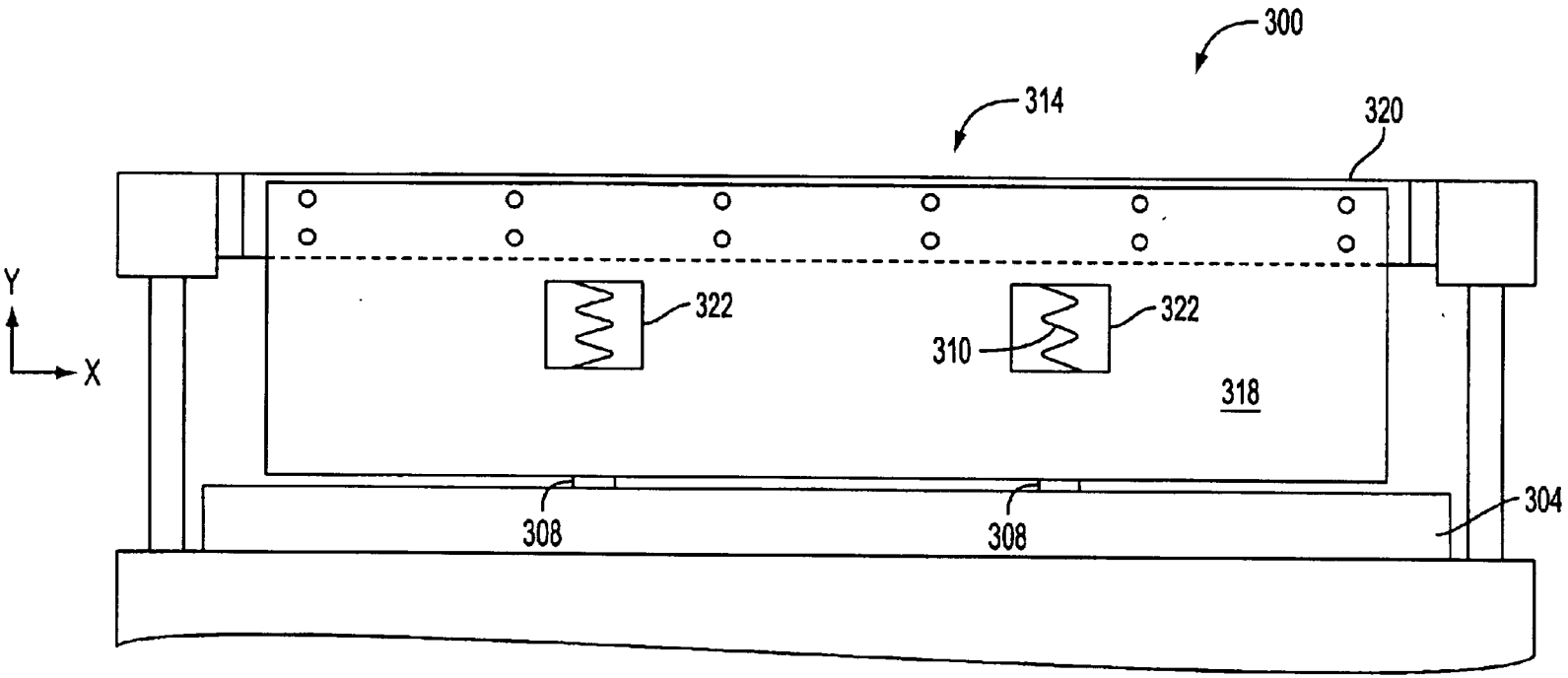
FIG. 3 is a front view of a sheet folding apparatus in accordance with another embodiment of the present invention.

FIG. 3 illustrates an alternative embodiment of a folding apparatus 300 having a fold blade 304 and a fold blade receptacle 314. As shown in FIG. 3, fold blade receptacle 314 includes two continuous flexible spring members 318 having openings 322 for receiving springs 310 of clamps 308. This alternative embodiment of FIG. 3 may provide simplified assembly of folding apparatus 300 and reduced likelihood of damage to sheets due to contact with edges of flexible spring members 318. Openings 322 are provided at the central portions of flexible spring members 318 which are closest together (between the fixed ends and the cantilevered ends) and allows springs 310 as well as clamps 308 to move freely within fold blade receptacle 314.

Figure 4:
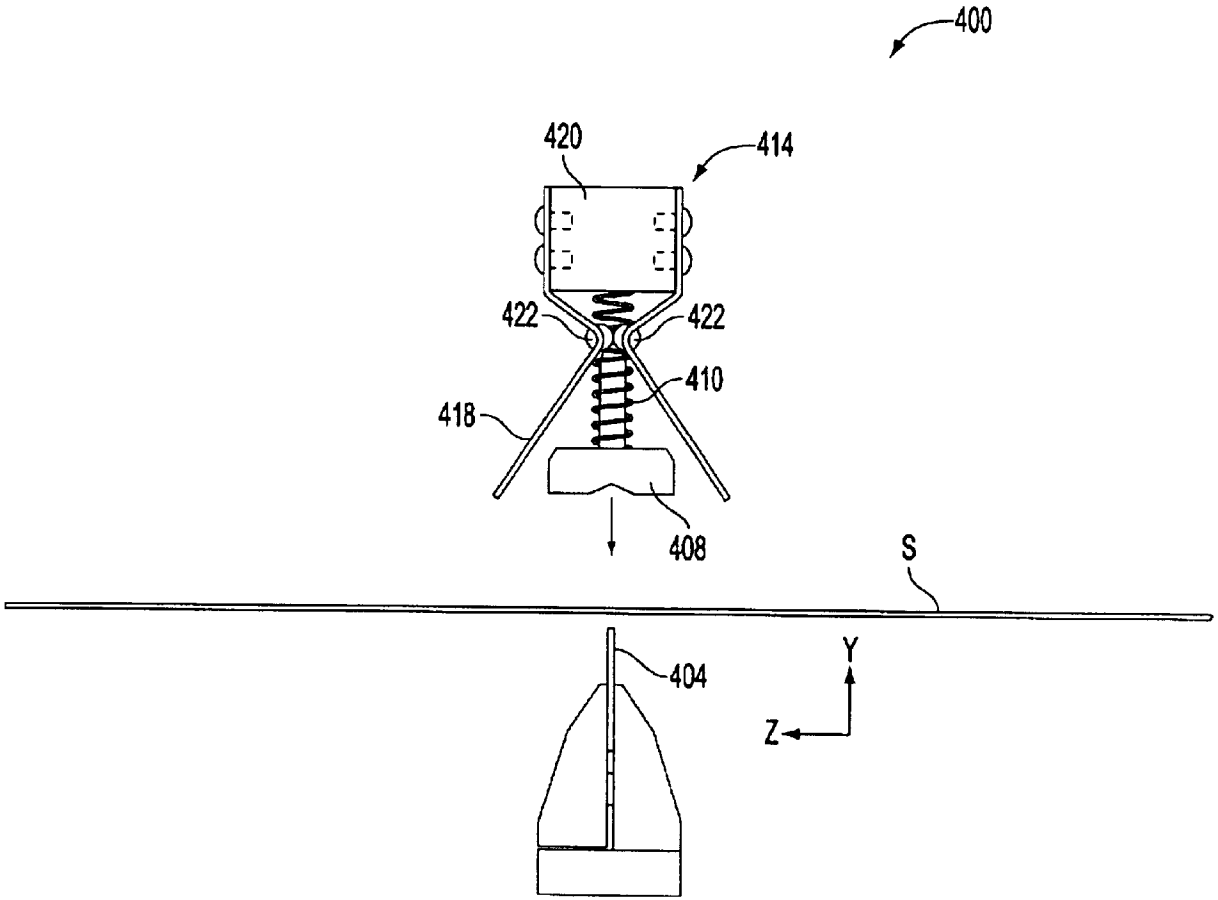
FIG. 4 is a side view of a sheet folding apparatus in accordance with another embodiment of the present invention.
Figure 5:
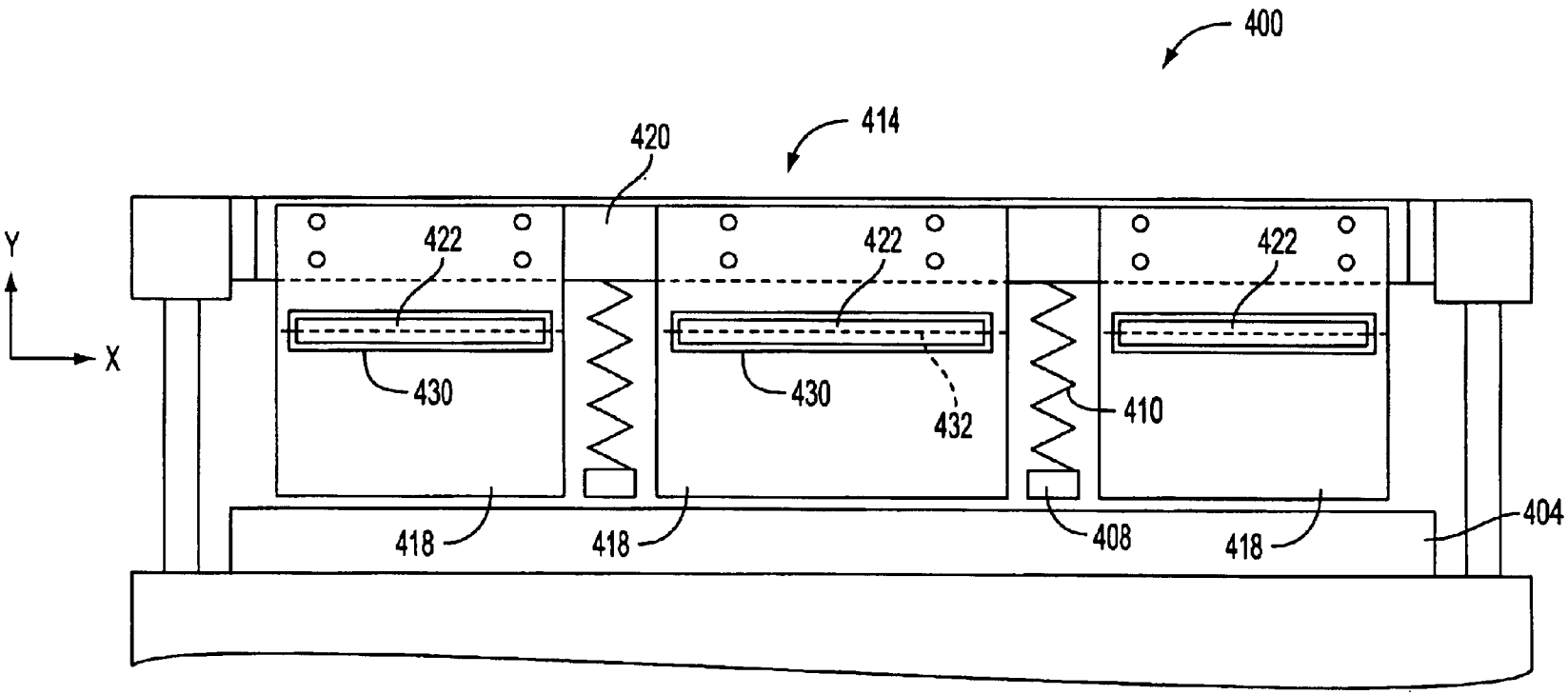
FIG. 5 is a front view of the sheet folding apparatus of FIG. 4.

FIG. 4 illustrates an alternative embodiment of a folding apparatus 400 having a fold blade 404 and a fold blade receptacle 414. As shown in FIG. 4, fold blade receptacle 414 includes flexible spring members 418, each having a roller 422 mounted thereon. Fold blade receptacle 414 includes clamps 408 supported by springs 410 and flexible spring members 418 supported on support 420. As illustrated in FIG. 5, fold blade rollers 422 are each mounted in an opening 430 in an associated flexible spring member 418 by a shaft 432. Shaft 432 can be fixed to flexible spring members 418 in any known manner, such as by crimping the shaft to the metal of the of the flexible spring members. Rollers 422 are provided to reduce friction between flexible spring members 418 and sheet S and to reduce the possibility of damage to the sheet. Rollers 422 may be coated with an elastomer to further conform to fold blade 404 and form a sharp fold.

In each of the embodiments described above, each of flexible spring members 118, 318, 418 have a fixed end fixed to the support and a free end. The free ends of flexible spring members 118, 318, 418 are cantilevered and biased toward one another. The center portions of the flexible spring members 118, 318, 418 between the fixed and free ends are biased to contact fold blade 104, 304, 404 (and the sheet) when the fold blade and receptacle are moved toward each other.

According to one example of the invention, flexible spring members 118, 318, 418 can provide an inwardly directed force of about 1 to about 10 lbs for folding 8½ inch wide sheets. However, the force for folding may be somewhat lower for very thin papers or somewhat higher for thicker papers. In addition, a friction reducing coating can be provided on flexible spring members 118, 318, 418 to prevent damage to the sheets. Examples of friction reducing coatings are PTFE and silicone. In addition, selection of materials and deburring procedures may be used to reduce friction and possible damage to sheets. Fold rollers 422 of FIGS. 4 and 5 are also used to prevent damage to sheet S caused by the inwardly directed force of flexible spring members 418.

Figure 6:
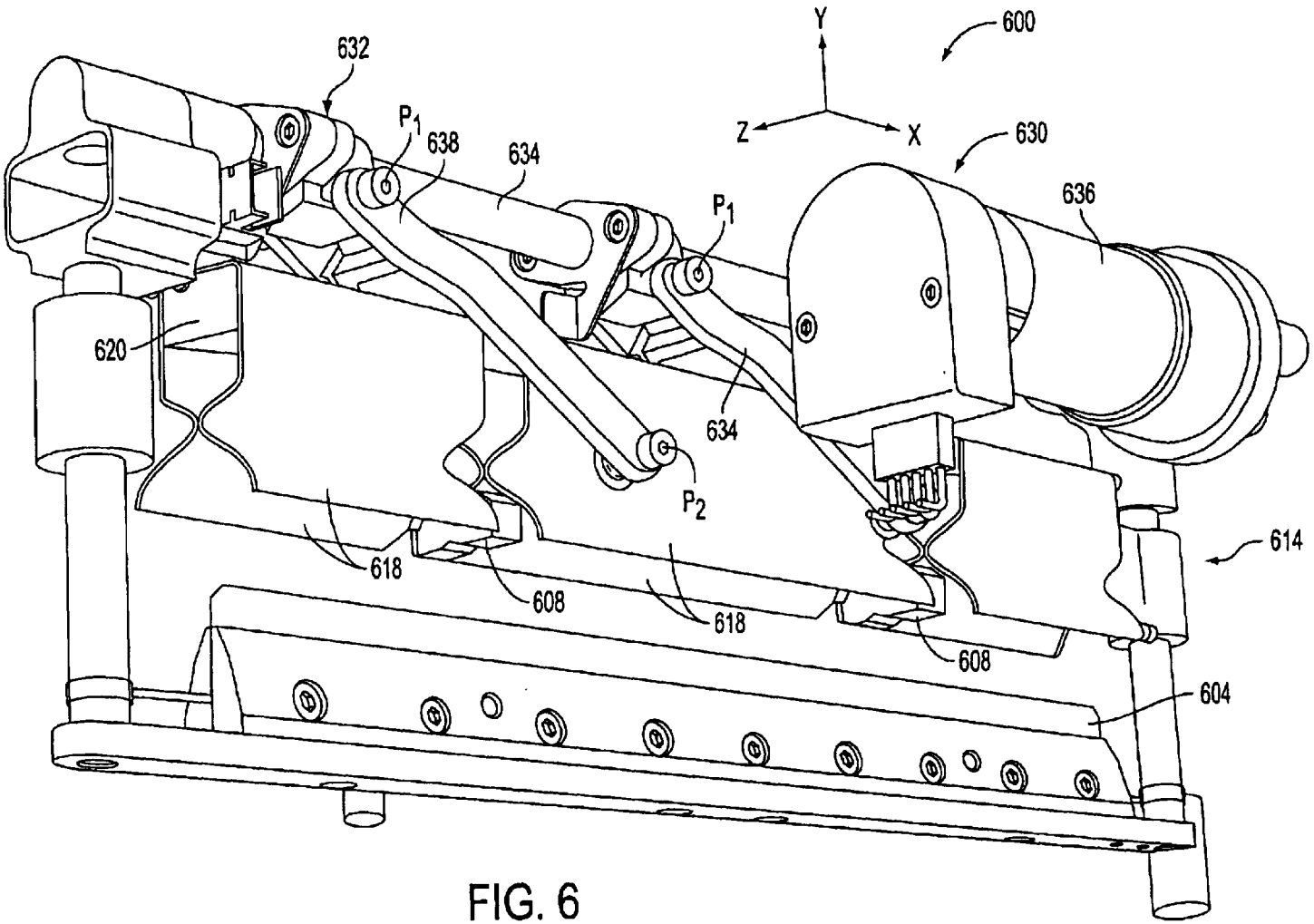
FIG. 6 is a perspective view of the sheet folding apparatus of FIGS. 1A–1C.

FIG. 6 illustrates an alternative embodiment of a folding apparatus 600 including a fold blade 604, a fold blade receptacle 614, and a drive means 630. Fold blade receptacle 614 includes a plurality of flexible spring members 618 mounted on a support 620 and clamps 608 positioned in spaces between the flexible spring members.

A drive means, such as drive means 630 in FIG. 6, can be provided for moving at least one of fold blade 604 and fold blade receptacle 614 into operable communication with one another. As referred herein, "operable communication" means placement of fold blade 604 and/or fold blade receptacle 614 relative to one another to achieve a desired fold in a sheet. In an exemplary embodiment, drive means 630 includes a coupling, such as coupling 632, and an actuator, such as lead screw 634, attached to the coupling, wherein rotation of the lead screw in a first direction is operable to move fold blade receptacle 614 against fold blade 604 to create a fold in a sheet. In the example shown in FIG. 6, drive means 630 includes coupling 632, lead screw 634, and motor 636. Motor 636 can be of any conventional type (such as electric, pneumatic, or hydraulic), or can be of any other type. The exemplary lead screw 634 can be rotated by motor 636 via a drive belt or alternatively via any other power transmitting element, such as a chain, or can be replaced by another type of actuator, such as a piston.

The exemplary coupling 632 includes linking members 638, which are rotatably attached to traveling members 640 and support 620 at pivot points $P_1$ and $P_2$, respectively, by any conventional or other pivoting means.

An exemplary embodiment of the drive means 630 is described in further detail in U.S. patent application Ser. No. 09/970,730 filed on Oct. 5, 2001, which is incorporated herein by reference in its entirety.

Flexible spring members 118, 318, 418, 618 can be arranged to form an acute angle between the cantilevered ends of the flexible spring members and fold blade 104, 308, 408, 608 and provide a coarse fold in the sheet S. The central contacting portions of flexible spring members 118, 318, 418, 618 pinch the sheet tightly to provide a fine fold in the sheet. The flexible spring members may be manufactured as two independent spring elements as illustrated in the embodiment of FIGS. 1A–1C or as a single unitary member as illustrated in the embodiment of FIG. 6.

The folding apparatus of the present invention can be used in a booklet making system such as that described in the Trovinger PCT which has previously been incorporated by reference. The booklet making system described in the Trovinger PCT can be used in conjunction with a laser printer or other printer to achieve low cost, high volume, booklet making in a sheet-wise manner. A sheet-wise booklet maker performs operations including trimming, folding, and punching on individual printed sheets of material. After the trimming, folding, and punching operations, the sheets are stacked and stapled by the booklet maker to form a finished booklet.

The exemplary embodiments of the present invention described above provide for quicker folding of individual sheets of material at a lower apparatus cost due to the use of a single motor to drive the fold blade receptacle in a single axis. In addition, the flexible spring fingers providing cantilevered spring action for folding eliminate the need for spring biased rollers. The use of flexible spring members reduces the part count and the complexity of the parts resulting in a lower overall apparatus cost.

An apparatus for folding sheet material according to an alternative embodiment of the invention is represented as apparatus 700 in FIGS. 7A–7D. The exemplary apparatus 700 includes a fold blade, such as fold blade 704. Apparatus 700 also includes a clamping means, such as clamping member 706, illustrated in FIGS. 7A–7D for clamping sheet S against fold blade 704. Sheet S is folded by motion of a plurality of sequentially activated fingers 708*a*–708*h* which are movable with respect to fold blade 704. Sequentially activated fingers 708*a*–708*h* are activated to fold sheet S by a plurality of cams 710*a*–710*h* mounted on a shaft 712. Sequentially activated fingers 708*a*–708*h* are shown to be activated by rotary cams 710*a*–710*h*. However, other activation members may also be used to advance the sequentially activated fingers and fold sheet S. The sequentially activated fingers 708*a*–708*h* are biased upwards by one or more springs (not shown). Apparatus 700 also includes a vertical stop member 714 for stopping the upward motion of sequentially activated fingers 708*a*–708*h* and clamping member 706.

In one preferred embodiment of apparatus 700, sequentially activated fingers 708*a*–708*h* extend along an entire width of sheet S to be folded and one or more activation systems in the form of cams 710*a*–710*h* are provided to advance the fingers and thereby fold the sheet. At least two activating cam systems can be provided for advancing sequentially activated fingers 708*a*–708*h*. The number of sequentially activated fingers 708*a*–708*h* may be varied depending on the application. At least four sequentially activated fingers can used with at least two fingers on each side of the clamping member 706.

Figure 7A:
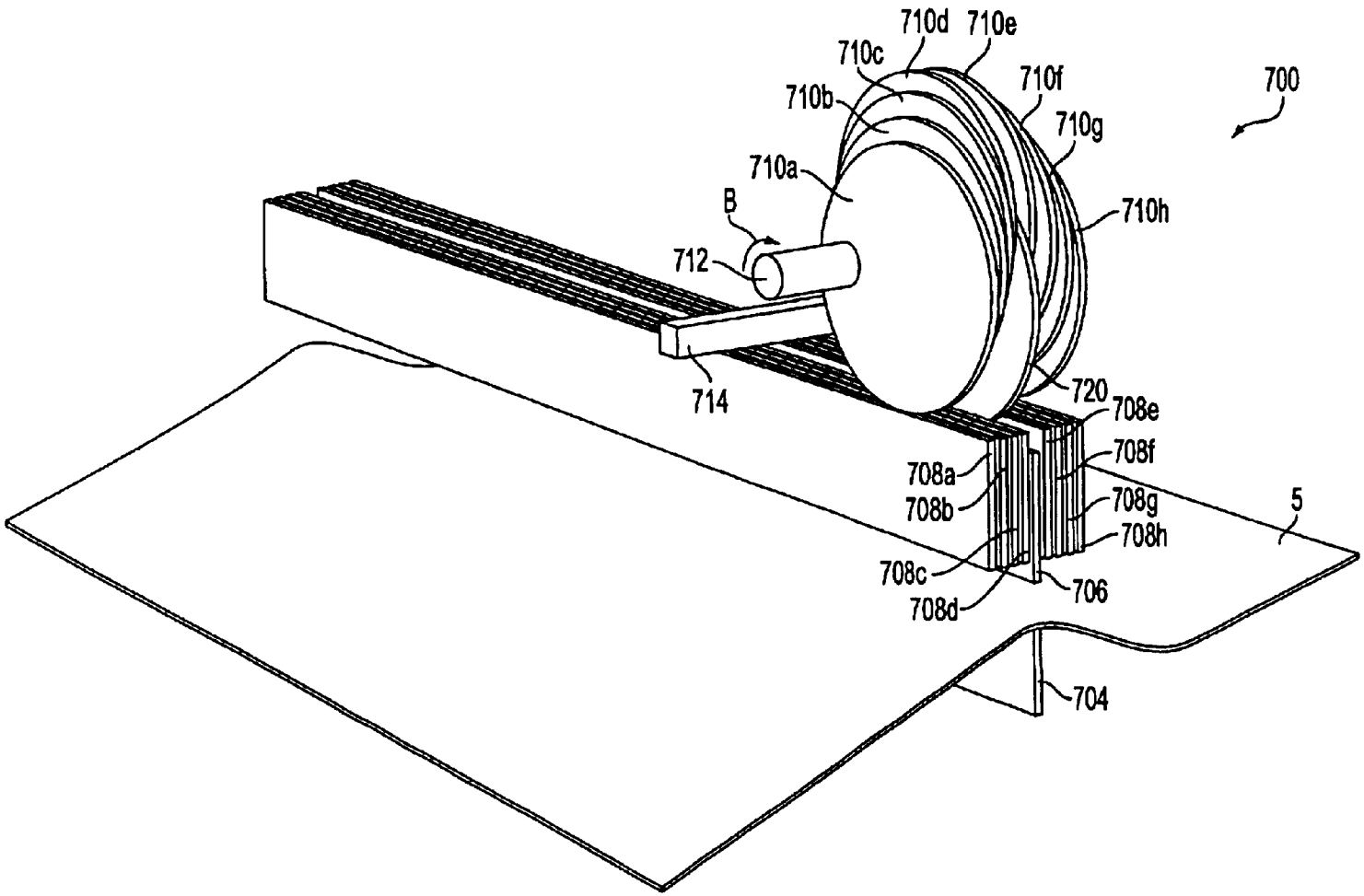
FIGS. 7A–7D illustrate the folding of a sheet with a sheet folding apparatus in accordance with an alternative embodiment having sequentially activated fingers.
Figure 7B:
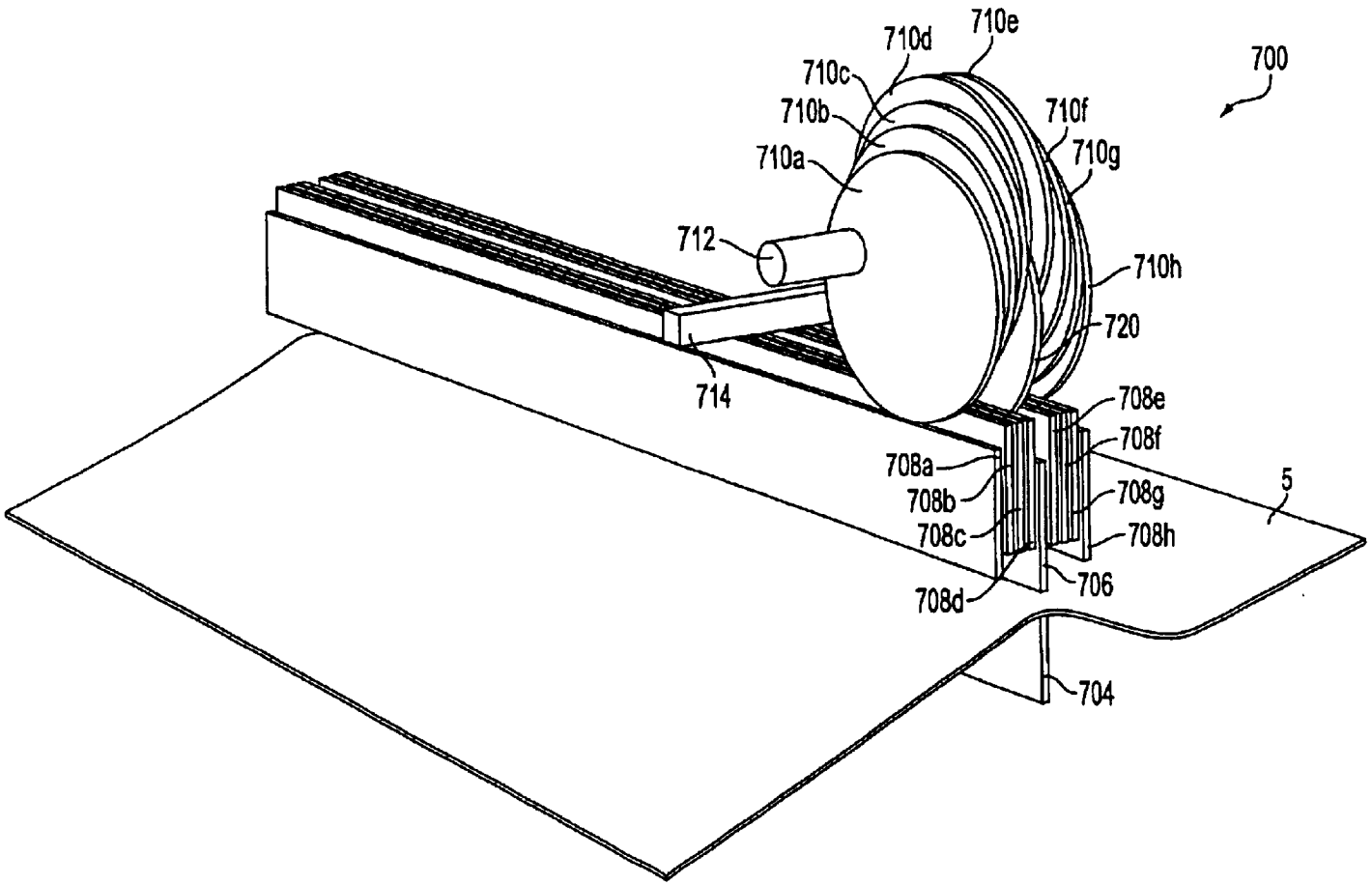
Figure 7C:
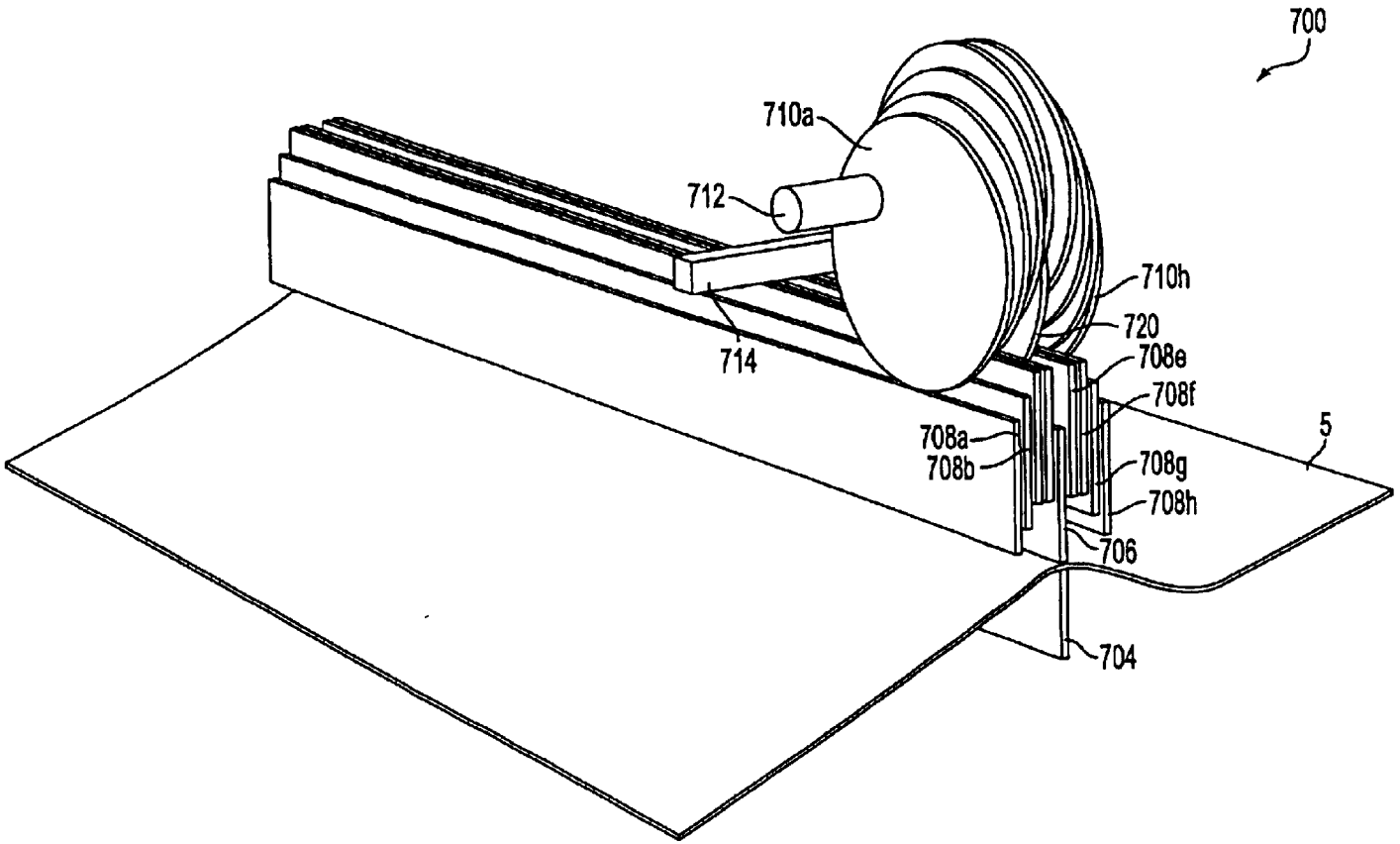
Figure 7D:
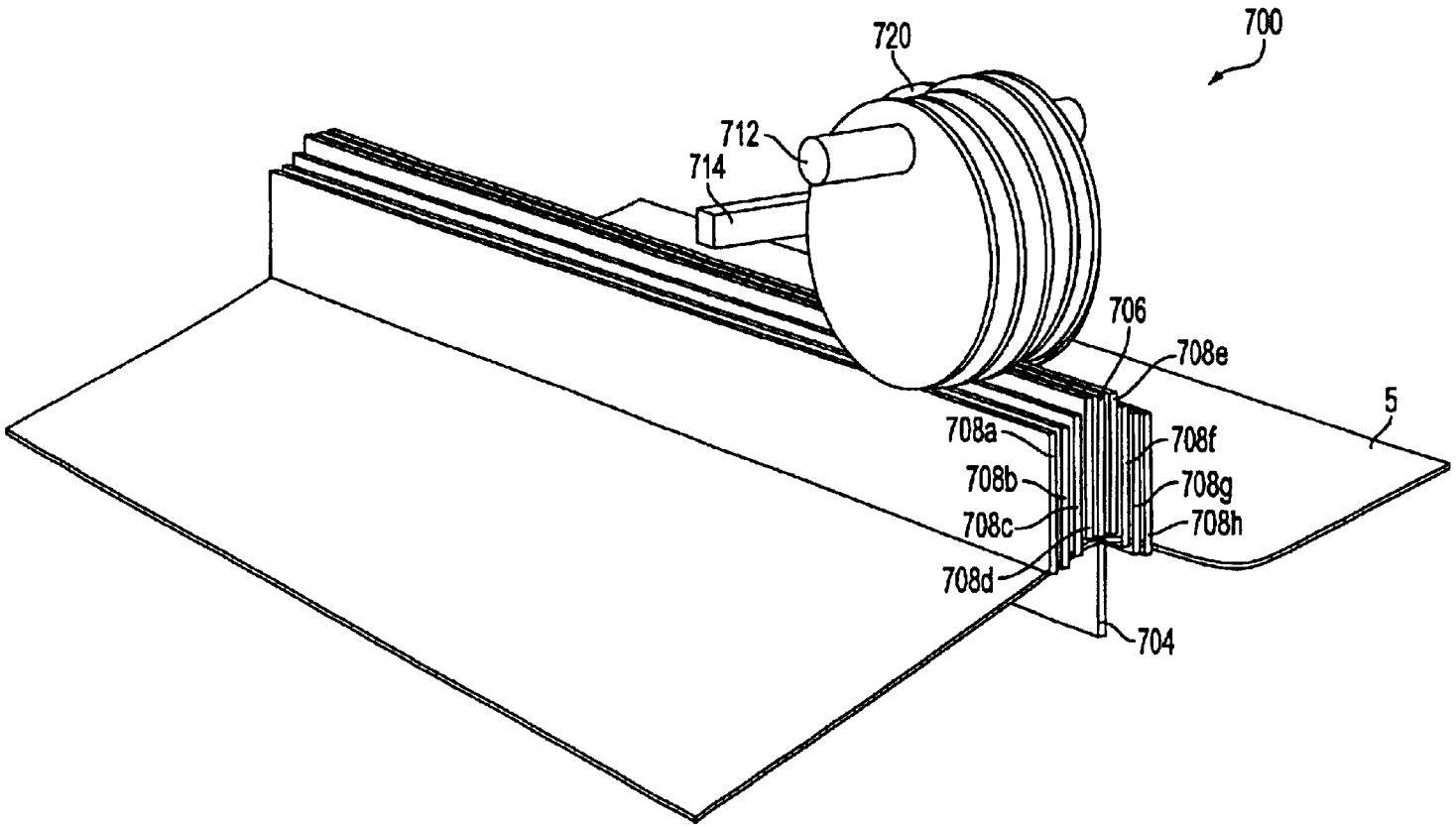

In operation of the apparatus for folding sheet material 700, a sheet S is advanced to a position between fold blade 704 and clamping member 706 as illustrated in FIG. 7A. Clamping member 706 is then advanced by a central cam 720 to clamp sheet S against fold blade 704 by rotation of cam shaft 712 in the direction of arrow B. After clamping of sheet S with clamping member 706, cams 710*a*–710*h* contact sequentially activated fingers 708*a*–708*h* to begin folding the sheet by advancing outer fingers 708*a* and 708*h* first followed by sequentially advancing middle and inner fingers. The advancement of outer fingers 708*a* and 708*h* starts the fold in sheet S and allows the general form of a fold to be created. As shown in FIGS. 7B, 7C, and 7D, the remaining fingers are then sequentially advanced to complete the fold.

The entire folding process can be performed by rotation of cam shaft 712 and the associated precisely shaped cams 710*a*–710*h* which achieve the sequential advancement of fingers 708*a*–708*h*.

Clamping member 706 can be attached to cam shaft 712 by a spring element (not shown) which allows central cam 720 to move with respect to cam shaft 712 after clamping sheet S against fold blade 704. After formation of the fold, sequentially activated fingers 708*a*–708*h* and clamping member 706 return to the initial position illustrated in FIG. 7A due to one or more springs (not shown) which bias fingers 708*a*–708*h* and clamping member 706 to the initial position illustrated in FIG. 7A.

It will be appreciated by those skilled in the art that the present invention can be embodied in other specific forms without departing from the spirit or essential characteristics thereof. The presently disclosed embodiments are therefore considered in all respects illustrative and not restricted. The scope of the invention is indicated by the appended claims rather than the foregoing description and all changes that come within the meaning and range and equivalence thereof are intended to be embraced within.

What is claimed is:

1. A sheet folding apparatus, comprising:

a fold blade;

a clamp movable to engage the fold blade; and a fold blade receptacle having two flexible spring members biased toward one another a midpoint to form a static pinch point, wherein the fold blade and the fold blade receptacle are movable toward one another to pass a portion of the sheet of material through the pinch point to fold a sheet of material.

2. The apparatus of claim 1, wherein the fold blade receptacle further comprises a support, wherein the two spring members each have a fixed end fixed to the support and a free end.

3. The apparatus of claim 2, wherein the free ends of the two spring members are cantilevered from the support and biased away from one another at the free end.

4. The apparatus of claim 2, wherein the static pinch point contacts the fold blade when the fold blade and receptacle are moved toward each other.

5. The apparatus of claim 1, wherein the spring members are formed of metal.

6. The apparatus of claim 1, wherein the spring members have a friction reducing coating.

7. The apparatus of claim 1, further comprising a fold roller mounted on each of the spring members.

8. The apparatus of claim 1, wherein the clamp is elastically mounted to the fold blade receptacle.

9. The apparatus of claim 1, wherein each spring member comprises multiple spring fingers.

10. The apparatus of claim 9, wherein the clamp is positioned in a space between two fingers.

11. The apparatus of claim 1, wherein the clamp is positioned in a slot in the spring members.

12. The apparatus of claim 1, wherein the fold blade is positioned in a plane which passes between the spring members.

13. The apparatus of claim 1, wherein the receptacle is movable along a linear path orthogonal to the sheet material to be folded.

14. A sheetwise booklet maker including the apparatus of claim 1, wherein the booklet maker includes a sheet transport path configured to transport individual sheets through a sheetwise trimming apparatus and through the folding apparatus in a sheetwise manner, and to transport the individual sheets to a binding station.

15. An apparatus for folding sheet material, comprising:

a fold blade;

clamping means for clamping a sheet against the fold blade;

folding means for folding the sheet over the fold blade, the folding means including two flexible spring members for receiving the fold blade therebetween, wherein the flexible spring members are biased toward one another at a midpoint to form a static pinch point; and drive means for moving at least one of the fold blade and the folding means into a position where the fold blade is between the static pinch point and the sheet is folded over the fold blade and between the two flexible spring members.

16. The apparatus of claim 15, wherein the fold blade receptacle further comprises a support, wherein the two spring members each have a fixed end fixed to the support and a free end.

17. The apparatus of claim 16, wherein the free ends of the two spring members are cantilevered from the support and biased away from one another at the free end.

18. The apparatus of claim 16, wherein the static pinch point contacts the fold blade when the fold blade and receptacle are moved toward each other by the drive means.

19. The apparatus of claim 15, wherein the spring members are formed of metal.

20. The apparatus of claim 15, further comprising a fold roller mounted on each of the spring members.

21. The apparatus of claim 15, wherein each spring member comprises multiple spring fingers.

22. The apparatus of claim 21, wherein the clamping means is positioned in a space between the two fingers.

23. The apparatus of claim 15, wherein the clamping means is positioned in a slot in the spring members.

24. The apparatus of claim 15, wherein the fold blade is positioned in a plane which passes between the spring members at the static pinch point and the folding means is movable along a linear path orthogonal to the sheet material to be folded.

25. A sheetwise booklet maker including the apparatus of claim 15, wherein the booklet maker includes a sheet transport path configured to transport individual sheets through a sheetwise trimming apparatus and through the folding apparatus in a sheetwise manner, and to transport the individual sheets to a binding station.

26. The apparatus of claim 5, wherein the bias is determined by one or more of an elastic property of the metal, a shape of the spring members and a thickness of the spring members.

27. The apparatus of claim 26, wherein the shape is an arcute shape.

* * * * *